US007661269B2

(12) United States Patent
Bonzani et al.

(10) Patent No.: US 7,661,269 B2
(45) Date of Patent: Feb. 16, 2010

(54) GAS TURBINE BURNER

(75) Inventors: Federico Bonzani, Genoa (IT); Giacomo Pollarolo, Genoa (IT)

(73) Assignee: Ansaldo Energia S.p.A., Genoa (IT)

( * ) Notice: Subject to any disclaimer, the term of this patent is extended or adjusted under 35 U.S.C. 154(b) by 687 days.

(21) Appl. No.: 10/563,800

(22) PCT Filed: Jul. 25, 2003

(86) PCT No.: PCT/IT03/00462

§ 371 (c)(1),
(2), (4) Date: May 25, 2006

(87) PCT Pub. No.: WO2005/010438

PCT Pub. Date: Feb. 3, 2005

(65) Prior Publication Data

US 2006/0266046 A1 Nov. 30, 2006

(51) Int. Cl.
*F02C 1/00* (2006.01)
*F02G 3/00* (2006.01)

(52) U.S. Cl. ..... 60/748; 60/737; 60/746

(58) Field of Classification Search ..... 60/737, 60/740, 748, 742, 746, 747, 804
See application file for complete search history.

(56) References Cited

U.S. PATENT DOCUMENTS 3,912,164 A * 10/1975 Lefebvre et al. ..... 239/5
4,600,151 A 7/1986 Bradley
4,701,124 A * 10/1987 Maghon et al. ..... 431/284
4,890,453 A 1/1990 Iwai et al.
5,450,725 A * 9/1995 Takahara et al. ..... 60/737
5,451,160 A 9/1995 Becker
5,660,045 A 8/1997 Ito et al.
5,664,943 A * 9/1997 Joos et al. ..... 431/8
5,700,143 A * 12/1997 Irwin et al. ..... 431/284
5,836,164 A * 11/1998 Tsukahara et al. ..... 60/733
6,434,945 B1 * 8/2002 Mandai et al. ..... 60/740
6,898,938 B2 * 5/2005 Mancini et al. ..... 60/748
7,143,583 B2 * 12/2006 Hayashi et al. ..... 60/776
7,370,478 B2 * 5/2008 Rocca ..... 60/776
2005/0028526 A1 * 2/2005 Von Der Bank ..... 60/748

FOREIGN PATENT DOCUMENTS

DE 10 60 082 6/1959

(Continued)

OTHER PUBLICATIONS

Opposition of European Patent No. 1 649 219 B1, filed Jan. 29, 2009 in the European Patent Office by Siemens AG.

(Continued)

*Primary Examiner*—William H Rodriguez
(74) *Attorney, Agent, or Firm*—Dickstein Shapiro LLP

(57) ABSTRACT

A turbine burner (1) comprising a secondary feed unit for the supply of a backup mixture and a primary feed unit intended for the supply of a primary mixture comprising lean gas, comprising a primary mixture channel (24). The primary mixture channel (24) has an annular wall (28) having a truncated cone-shaped end portion (30) capable of conveying the primary mixture directly to the combustion zone (6) facing the axial swirler (18), achieving efficient combustion even for primary mixtures comprising gases with a low calorific value.

15 Claims, 6 Drawing Sheets

FOREIGN PATENT DOCUMENTS

| | | |
|---|---|---|
| DE | 197 57 617 A1 | 3/1999 |
| EP | 0 193 838 B1 | 5/1989 |
| EP | 0 924 462 | 6/1999 |
| EP | 1 239 219 | 9/2002 |
| EP | 1 277 920 | 1/2003 |

OTHER PUBLICATIONS

Response to Opposition of European Patent No. 1 649 219 B1, by applicant.

* cited by examiner

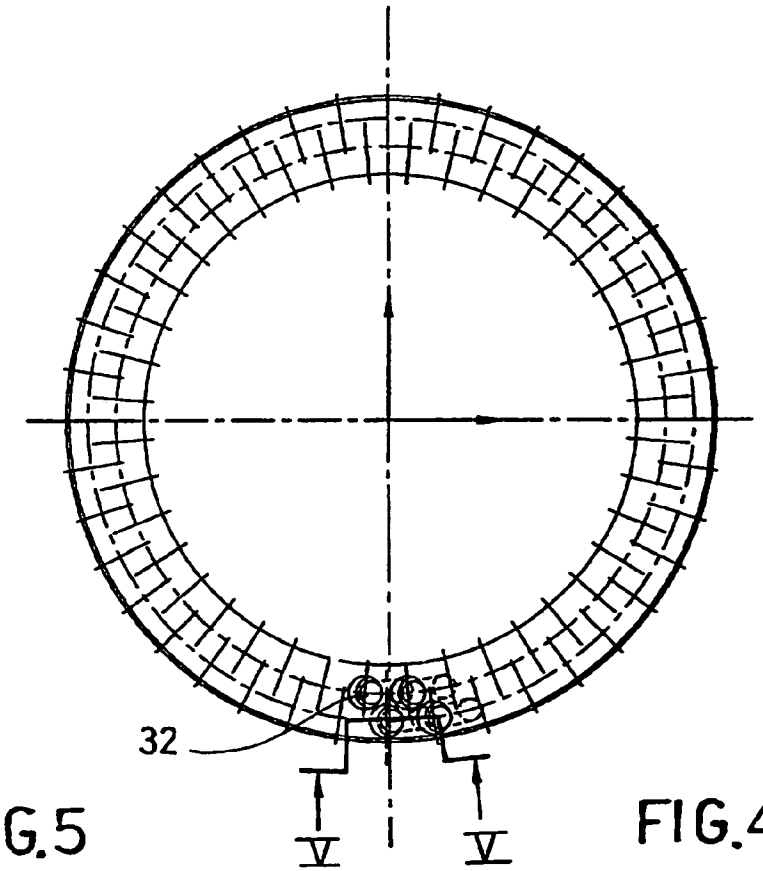
FIG.4b
FIG.5
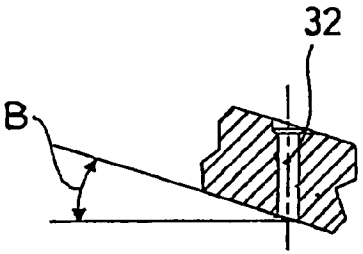
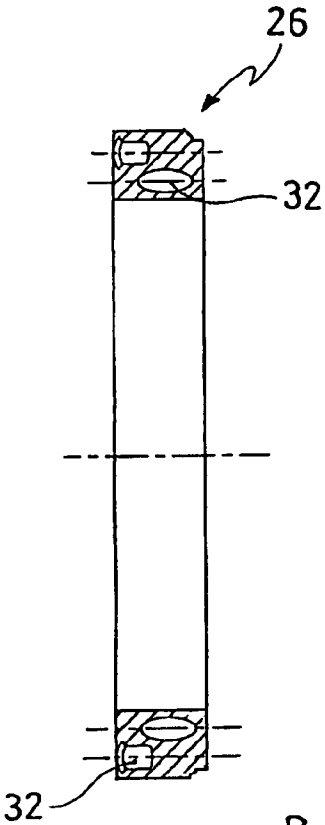
FIG.4a

| Lean gas | $H_2$ [% vol] | CO [% vol] | $H_20$ [% vol] | $N_2$ [% vol] | $CO_2$ [% vol] | $CH_4$ [% vol] | Flame velocity [m/s] | Lower heating value [MJ/kg] |
|---|---|---|---|---|---|---|---|---|
| A | 27 | 33 | 35 | 2 | 3 | - | 1.60 | 8.60 |
| B | 9 | 16 | - | 46 | 14 | 15 | 0.39 | 7.30 |
| C | 10 | 10 | 26 | 25 | 8 | 21 | 0.35 | 10.00 |
| D | 2 | 17 | - | 48 | 14 | 19 | 0.30 | 7.30 |

Figure 7

GAS TURBINE BURNER

SUMMARY OF THE INVENTION

The subject of the invention is a burner intended for the use of non-conventional fuels in gas turbines, for example in plant for the production of electrical energy.

It is known practice in the industry to use the term non-conventional fuels to mean fuels different from those such as natural gas and light gas oil (diesel oil) usually employed in gas turbines.

Currently known solutions for burners for non-conventional gases are embodied taking into account the need to burn different mixtures depending on the conditions of operation of the plant which supplies the recovered fuel which can be used by the burner or depending on the requirements of the electrical network supplied by the plant of which the turbine is part.

For example, there is the known case where, on starting up the gas turbine or when the power demand from the electrical network is very low, burner operation provides for combustion with a so-called backup mixture, generally consisting of a mixture of natural gas and steam or gas oil or gas oil and water, of course together with air.

In nominal conditions, burner operation provides for combustion of a primary mixture formed, for example, of a primary gas and an inert gas, for example steam or nitrogen, together with air.

All of this makes it necessary, in the structure of a burner, to provide suitable tubes to convey the various mixtures, in optimum conditions for proper mixing of the components and for efficient interaction with the combustion air, to a combustion zone in which combustion actually occurs.

Furthermore, a requirement has arisen recently for burners to be produced suitable for the combustion of primary mixtures with widely differing compositions. In other words, it has become necessary to devise burners capable of achieving efficient combustion of primary mixtures which are not of a constant composition.

The problem addressed by the invention is that of devising a burner for gas turbines which has structural and operating characteristics such as to meet the above-mentioned requirements and at the same time eliminate the disadvantages mentioned with reference to the known technology.

This problem is solved by a burner in accordance with claim 1. Other forms of embodiment of the invention are described in the dependent claims.

The characteristics and advantages of the burner according to the invention will become clear from the following description provided purely by way of a preferred, non-limiting example, in which:

BRIEF DESCRIPTION OF THE DRAWINGS

FIGS. 4*a* and 4*b* show respectively a view in longitudinal section and a rear view of a nozzle ring of the primary mixture channel in FIG. 3*a;*

FIG. 5 shows a view in section of a detail of FIG. 4*b;*

FIG. 7 shows a table giving experimental data regarding the composition, flame velocity and lower heating value of lean gases used in the burner according to the invention.

DESCRIPTION OF THE PREFERRED EMBODIMENTS

Figure 1:
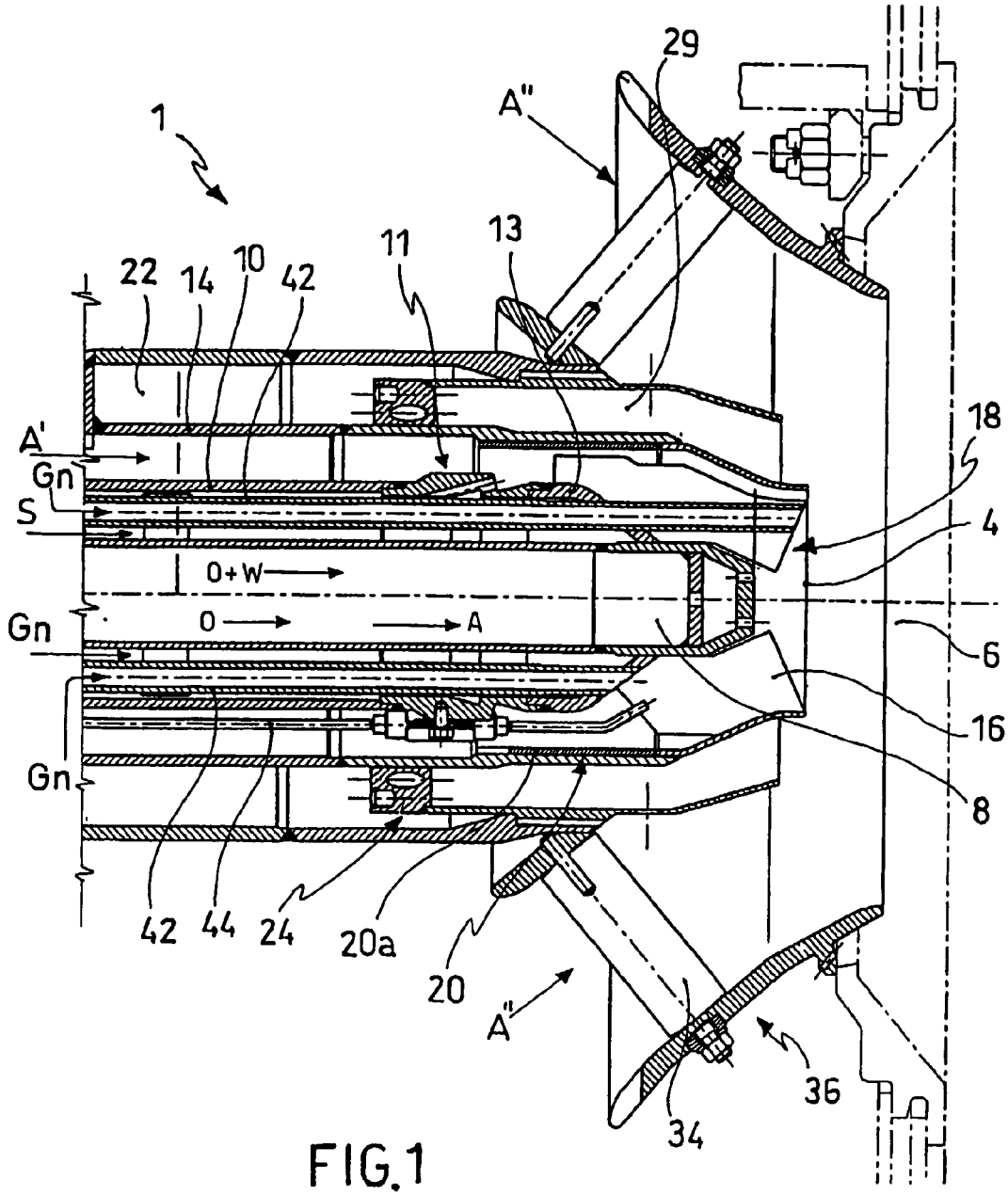
FIG. 1 shows a view in longitudinal section of a burner according to the invention.
Figure 2:
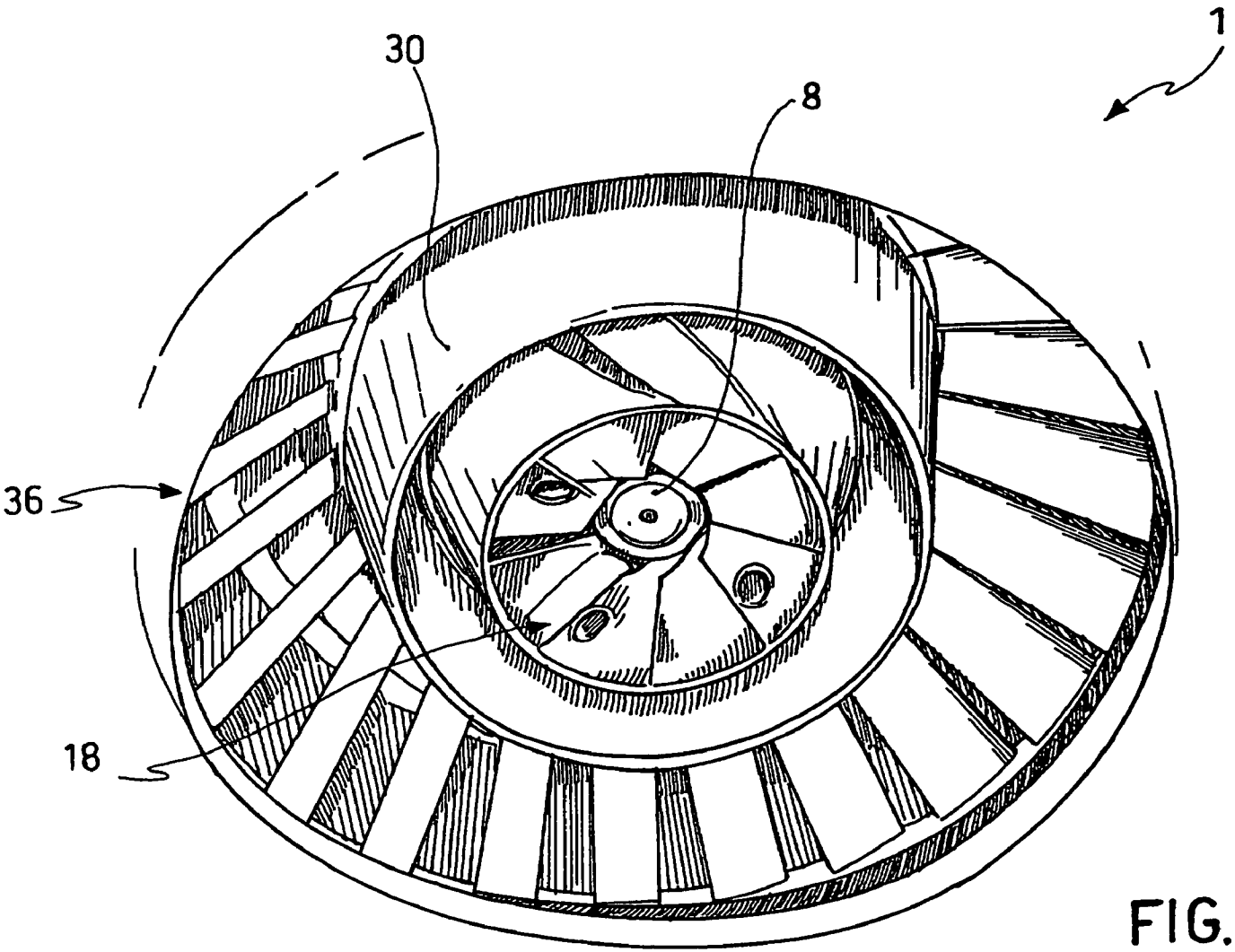
FIG. 2 shows a view in isometric projection of the end portion of the burner in FIG. 1.

With reference to the appended drawings, the number 1 indicates as a whole a turbine burner intended particularly for use in association with gas turbines for electrical plant.

The burner 1 comprises a secondary feed unit intended to supply a secondary or backup mixture.

Said secondary feed unit is capable of supplying and discharging said secondary mixture from an opening 4 to a combustion zone 6 facing said opening 4.

Said secondary mixture comprises, for example, natural gas and steam. In a further variant, said secondary mixture comprises gas oil. In a still further variant, said secondary mixture comprises gas oil and water.

In one form of embodiment, said secondary feed unit comprises a central tube 8, known as the spray nozzle, intended for the supply of a secondary mixture variant, for example composed of gas oil O only, or of gas oil O and water W. In a further variant, said spray nozzle 8 is intended for the supply of air A.

Furthermore, said secondary feed unit comprises a gas-steam tube 10, intended for the supply of a further secondary mixture variant, comprising natural gas Gn and steam S.

The gas-steam tube 10 is connected to a sleeve 11, of substantially cylindrical shape, provided with gas-steam holes 12 which provide communication between the inside of said sleeve and the outside of the sleeve.

The gas-steam holes 12 are arranged circumferentially along the annular wall of the sleeve 11 and have axes which are incident relative to the axis of the sleeve 11.

In a preferred form of embodiment, said gas-steam holes 12 can be varied in number between 10 and 18. In a still further form of embodiment, said gas-steam holes can be varied in number between 12 and 16. In a preferred embodiment, said gas-steam holes are 12 in number. In a further variant embodiment, said gas-steam holes are 16 in number.

Said gas-steam holes preferably have a constant angular pitch between the respective centres, for example equal to 18°.

In a preferred embodiment, the sleeve 11 is connected to a bell-shaped part 13 which closes around the spray nozzle 8.

In a preferred form of embodiment, the secondary feed unit comprises an axial air tube 14, intended to supply an axial airflow A'.

The gas-steam holes 12 are intended for the discharge of the secondary gas mixture formed of natural gas Gn and steam S towards the axial air tube 14.

The inclination of the axes of the gas-steam holes 12 is suitable for spraying said secondary mixture towards the wall of said axial air tube 14.

In a preferred form of embodiment, said secondary feed unit provides for a system of vanes 16, preferably twisted, known as an axial swirler 18.

Said vanes 16 are arranged concentrically relative to the axial air tube 14 and have a radial extension such as to allow the spray nozzle 8 to be located centrally.

The axial swirler 18 is arranged in the end part of the axial air tube 14, preferably not welded or rigidly attached to it.

Advantageously, said sliding fit between the axial air tube 14 and the axial swirler 18 absorbs the differences in thermal expansion between said axial air tube 14 and said axial swirler 18.

The vanes 16 of the axial swirler 18 are spaced circumferentially in order to produce swirl passages between one vane and the next for the axial airflow A' fed to the combustion zone 6.

In a preferred form of embodiment, said secondary feed unit provides for a baffle 20 preferably arranged upstream of the axial swirler 18 relative to the combustion zone 6.

Said baffle 20 comprises an annular wall 20*a*, preferably cylindrical, extending substantially axially.

The annular wall 20*a* is preferably arranged to fit closely against the inner surface of the axial air tube 14, axially adjacent to the axial swirler 18.

Preferably, said baffle 20 is arranged frontally relative to the gas-steam holes 12 of the gas-steam pipe 10.

The burner 1 also comprises a primary feed unit for the supply of at least one primary combustion mix.

For example, said primary mix comprises lean gas, for example derived from steel-making processes, and steam.

It is emphasised that in the specific sector of turbine burners, lean gas is taken to mean a gas having a lower heating value of less than 15,000 kJ/kg in general containing mainly hydrogen, carbon monoxide, methane and inert gas (carbon dioxide, nitrogen or steam).

The primary feed unit comprises a primary mixture tube 22 for the supply of the primary mixture.

Said primary feed unit also comprises a primary mixture channel 24 having a fluid flow connection to said primary mixture tube 22.

The primary mixture channel 24 provides for a nozzle ring 26 to which is connected, preferably by the outer peripheral edge, an annular wall 28.

The annular wall 28 of the primary mixture channel 26 forms, at a distance radially from the axial air tube 14, a cavity 29.

The annular wall 28 extends axially far enough to be close to the combustion zone 6, and is thus able to feed said primary mixture directly into said combustion zone 6 facing the axial swirler 18.

In a preferred form of embodiment, said annular wall 28 of the primary mixture channel 24 has a truncated cone-shaped end portion 30, converging in the direction of discharge of the primary mixture.

The nozzle ring 26 has a plurality of primary mixture holes 32, passing through said ring, so as to provide fluid flow communication between the primary mixture tube 22 and the cavity 29 between the annular wall 28 of the primary mixture channel 24 and the axial air tube 14.

In a preferred form of embodiment, said primary mixture holes 32 are organised so that the centres lie on two concentric circumferences, on which said holes are angularly staggered.

For example, said nozzle ring 26 has forty primary mixture holes 32 on each circumference, spaced apart, on each circumference, so as to have an angular pitch of 9°.

Advantageously, the primary mixture coming from the primary mixture tube 22 passes through said primary mixture holes 32 assuming a turbulent swirling motion as far as the combustion zone 6.

Figures 3A, 3B, 3C:
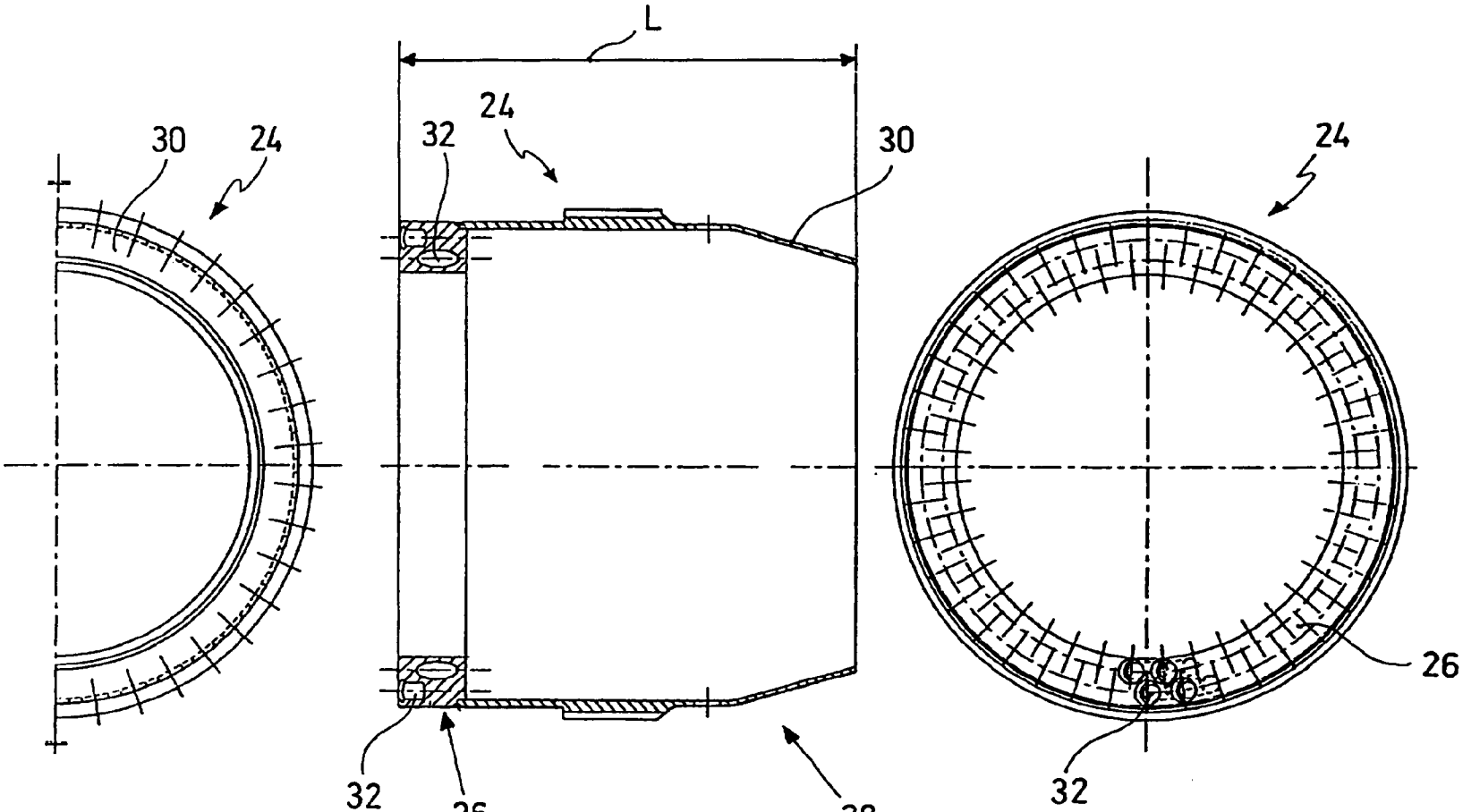
FIGS. 3*a* to 3*c* show respectively a view in longitudinal section, a front view and a rear view of a primary mixture channel of the burner in FIG. 1.
Figure 6B:
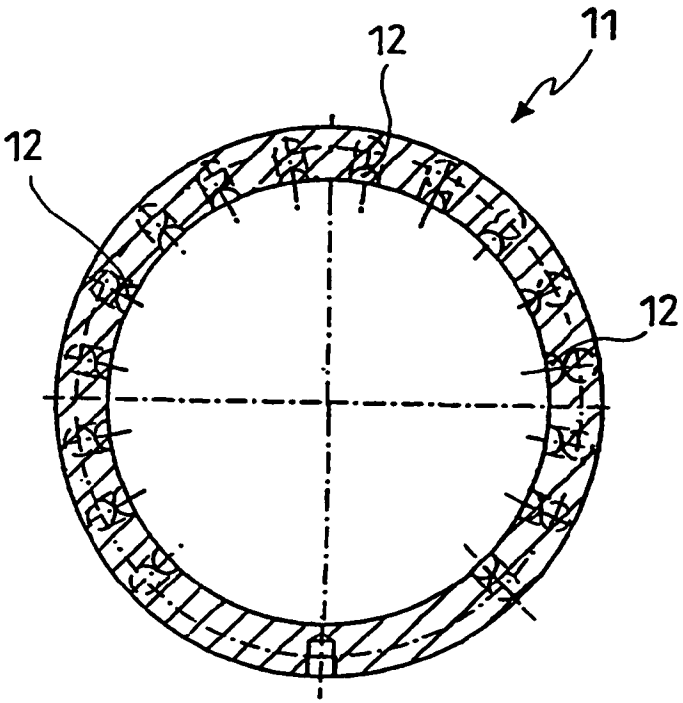
FIGS. 6*a* and 6*b* show respectively a view in longitudinal section and a rear view of a sleeve of the burner in FIG. 1.
Figure 6A:
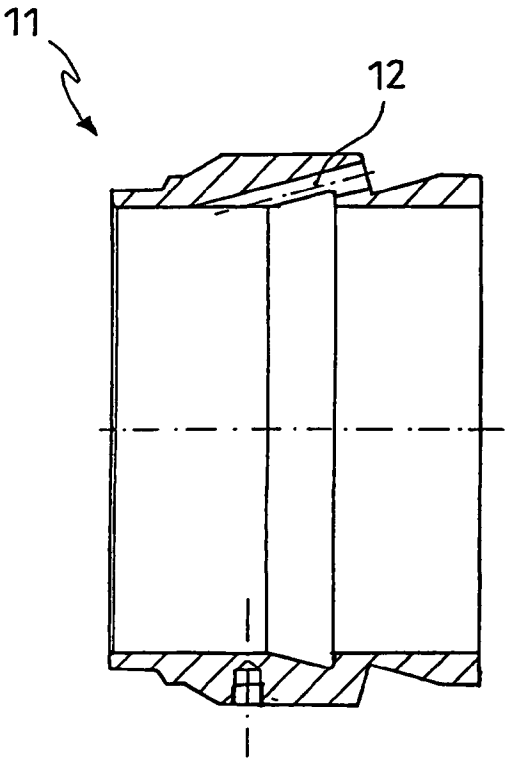

In one form of embodiment, said primary mixture channel 24 has an axial length L equal to 182.9 mm (FIG. 3*a*) and said primary mixture holes have an axis inclined as described above by an angle B equal to 17° (FIG. 5).

In a further form of embodiment, said primary mixture channel 24 has an axial length L equal to 194.85 mm (FIG. 3*a*) and said primary mixture holes have an axis inclined as described above by an angle B equal to 12° (FIG. 5).

Furthermore, said primary feed unit comprises an assembly of vanes 34, preferably twisted, known as a diagonal swirler 36, arranged concentrically with the primary mixture channel 24.

The diagonal swirler 36 is intended to convey a diagonal airflow A" to the combustion zone 6.

The vanes 34 of said diagonal swirler 36 are arranged spaced circumferentially so as to produce swirl passages through which the diagonal airflow A" is given swirl and turbulence so as to be suitable for effective combustion.

In one form of embodiment, the burner 1 also comprises a pilot unit.

Preferably said pilot unit comprises one or more pilot tubes 42 capable of supplying natural gas in particular operating situations of the turbine which may be associated with the burner 1, such as cases of shedding of the electrical load or reduction in the power required by the network.

Furthermore, said burner 1 comprises at least one pair of igniters 44.

In a first operating condition, for example on starting up the turbine, the burner 1 is used in a first combustion condition, known as natural gas backup.

In this condition, the burner 1 is supplied with a secondary mixture formed of natural gas and steam which is discharged from the gas-steam holes 12 of the sleeve 11.

The secondary flow is struck by the axial airflow A' coming from the axial air tube 14.

The mixture thus formed of air, steam and natural gas passes through the axial swirler 18 and reaches the combustion zone 6. There, combustion is further sustained by the diagonal airflow A" coming from the diagonal swirler 36.

The baffle 20 arranged axially upstream and adjacent to the axial swirler 18 prevents part of the inflammable secondary mixture, for example part of the steam-natural gas mixture, from being drawn towards the cavity 29 causing undesirable and harmful explosions when changing over from backup operation to nominal operation.

In a further operating condition on starting up the turbine, the burner is used in a further backup combustion condition, known as gas oil backup.

In this condition, the burner 1 is supplied with a secondary mixture formed of gas oil O and water W or of gas oil O only, exiting to the combustion zone 6 through the spray nozzle 8.

The secondary mixture is struck by the axial airflow A' coming from the axial air tube 14 through the axial swirler 18 and by the diagonal airflow A" coming from the diagonal swirler 36.

In the so-called nominal operating condition, the burner 1 is supplied with a primary mixture formed of primary gas, for example lean gas, and steam, pre-mixed upstream of the nozzle channel 24.

The primary mixture passes through the primary mixture holes 32 of the nozzle ring 26 which imparts to said primary mixture a swirling and turbulent motion along the cavity 29 until, maintaining this vigorous swirling motion, it arrives directly at the combustion zone 6 facing the outlet of the axial swirler 18.

This swirl and turbulence of the primary mixture are not damped by structural discontinuities in the nozzle channel 26, such as projections, lobes and similar.

Furthermore, the end portion 30 of the annular wall 28 of the primary mixture channel 24, of truncated cone shape, intensifies this swirl by reducing the cross-section through which the flow passes.

The primary mixture exiting from the primary mixture channel 24 directly to the combustion zone 6 is also struck by the axial airflow A' coming from the axial swirler 18, and by the diagonal airflow A", coming from the diagonal swirler 36.

The embodiment described above achieves high swirl numbers, the term swirl number, as is known in the sector, denoting a characteristic fluid-dynamics parameter derived from the ratio between the moment of the quantity of tangential motion and that of axial motion of the moving fluid.

Said high swirl numbers are within a range of values of between 2 and 3, while typical values in the known technology are equal to 0.8.

The embodiment described above has shown excellent operation in nominal conditions of the burner even with primary mixtures having an extremely variable composition. This is because the high degree of turbulence and swirl generated by the geometry of the burner maintain a stable flame front even for lean hydrogen primary mixtures.

In a further operating condition known as load shedding, in general resulting from disconnection of the plant from the electrical network or from an unexpected drop in the power required by the network, the burner is supplied with natural gas by the pilot tubes 42.

The natural gas in the combustion zone 6 is struck by the axial airflow A' and by the diagonal airflow A".

Unusually, the burner according to the invention has proved capable of achieving efficient combustion even when supplied with primary mixtures varying in composition and above all in the case of primary mixtures characterised by low hydrogen content.

For example, results of experiments carried out have shown that there are no undesirable phenomena such as flame separation, backfiring or pressure fluctuations induced by the combustion (the phenomenon generally known as humming).

In particular, the table given in FIG. 7 shows the composition and characteristics of the fuels used in gas turbines when supplying the burner according to the invention with a primary mixture containing lean gas having a different composition. The last two columns on the right of the table also give the values calculated for flame velocity and for lower heating value.

The burner according to the invention has shown excellent combustion capabilities with primary mixtures containing lean gas with a percentage of molecular hydrogen $H_2$ varying from 2% by volume to about 30% by volume.

The burner has also shown excellent combustion capabilities with flame velocities of between 0.3 m/s and 1.6 m/s.

Moreover, the burner has shown excellent combustion capabilities with gases having a low calorific value, between 7.3 MJ/Kg and 10.0 MJ/Kg, it being generally recognised in the industry that a gas is defined as having low calorific value up to a value of 15 MJ/kg.

According to a further advantageous aspect, the extended primary mixture channel, which directly supplies the primary mixture to the combustion zone facing the axial swirler, avoids the formation of residues, generally metallic such as iron and nickel powders, due to the presence of contaminants in the fuel which, particularly in some solutions in the known technology, are deposited on the axial swirler, requiring lengthy and difficult maintenance and/or repair work.

According to a further advantageous aspect, the baffle arranged upstream of the axial swirler in the axial air tube prevents an inflammable mixture from being drawn towards the cavity which, when changing over from backup operation to nominal operation, would lead to undesirable and dangerous explosions.

According to a further advantageous aspect, the number of the gas-steam holes in the sleeve maintain a large difference in pressure between the gas-steam pipe and the cavity, limiting the moving back of turbulence and instability from said cavity towards the gas-steam pipe.

Finally, according to a still further advantageous aspect, the primary mixture channel is of simple construction and can be used in place of designs already in operation to improve their efficiency.

It is clear that a person skilled in the art, for the purpose of meeting incidental and specific requirements, will be able to make numerous changes and produce numerous variants to the burner described above, without thereby departing from the scope of the invention as defined in the following claims.

The invention claimed is:

1. A turbine burner (1) comprising a secondary feed unit for the supply of a secondary or backup mixture and the discharge of said mixture from an opening (4) to a combustion zone (6) facing said opening (4), said secondary feed unit comprising an axial air tube (14) terminating in an axial swirler (18);

a primary feed unit comprising a primary mixture tube (22) and a primary mixture channel (24) intended for the supply of a primary mixture, arranged concentrically with said secondary feed unit and with said axial air tube (14), said primary mixture channel (24) having a fluid flow connection to said primary mixture tube (22), wherein said primary mixture channel (24) comprises an annular wall (28) forming, at a distance radially from the axial air tube (14), a cavity (29), and extending axially far enough to be close to the combustion zone (6), being thus capable of conveying said primary mixture directly to said combustion zone (6) facing said opening (4), directly downstream of the opening (4) of said axial swirler (18), and wherein the primary mixture channel (24) provides for a nozzle ring (26) having a plurality of primary mixture holes (32), passing through said ring, so as to provide fluid flow communication between the primary mixture tube (22) and the cavity (29) between the annular wall (28) of the primary mixture channel (24) and the axial air tube (14), whereby the primary mixture coming from the primary mixture tube (22) passes through said primary mixture holes (32) which impart to said primary mixture a swirling and turbulent motion along the cavity (29) until, maintaining this vigorous swirling motion, said primary mixture arrives directly at the combustion zone (6) facing the outlet of the axial swirler (18).

2. A burner according to claim 1, in which said annular wall (28) of the primary mixture channel (24) has a truncated cone-shaped end portion (30), converging in the direction of discharge of the primary mixture.

3. A burner according to claim 1, in which said primary mixture channel (24) comprises a nozzle ring (26) provided with primary mixture holes (32) having axes not parallel to the axis of said ring.

4. A burner according to claim 3, in which said primary mixture holes have an axis inclined by an angle (B) equal to 17.

5. A burner according to claim 4, in which said primary mixture channel has an axial length (L) equal to 182.8 mm.

6. A burner according to claim 3, in which said primary mixture holes have an axis inclined by an angle (B) equal to 12.

7. A burner according to claim 6, in which said primary mixture channel has an axial length (L) equal to 194.85 mm.

8. A burner according to claim 1, in which said secondary feed unit comprises a sleeve (11) connected to a gas-steam tube (10) intended for the supply of a secondary mixture comprising natural gas (Gn) and steam(S), said sleeve (11) comprising gas-steam holes (12).

9. A burner according to claim 8, in which said gas-steam holes are twelve in number.

10. A burner according to claim 8, in which said gas-steam holes are sixteen in number.

11. A burner according to claim 8, in which said gas-steam holes face towards a baffle (20) capable of preventing this secondary mixture from being drawn to the primary mixture channel (24).

12. A burner according to claim 1 in which said secondary feed unit comprises a spray nozzle (8) intended for the supply of a secondary mixture composed of gas oil (O) or gas oil and water (O+W) or intended for the supply of air (A).

13. A burner according to claim 1, also comprising a pilot unit comprising a plurality of pilot tubes (42) capable of supplying natural gas (Gn).

14. A burner according to claim 1, comprising at least one pair of igniters (44).

15. A burner according to claim 1, also comprising a diagonal swirler (36).

* * * * *

UNITED STATES PATENT AND TRADEMARK OFFICE

CERTIFICATE OF CORRECTION

PATENT NO. : 7,661,269 B2
APPLICATION NO. : 10/563800
DATED : February 16, 2010
INVENTOR(S) : Bonzani et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 777 days.

Signed and Sealed this

Fourth Day of January, 2011

David J. Kappos

David J. Kappos
*Director of the United States Patent and Trademark Office*